US006522721B1

(12) United States Patent
Lustberg

(10) Patent No.: US 6,522,721 B1
(45) Date of Patent: Feb. 18, 2003

(54) X-RAY TUBE HAVING SPHERICAL ANODE

(76) Inventor: Herb Lustberg, 146 Sherman Ct., Fairfield, CT (US) 06430

( * ) Notice: Subject to any disclaimer, the term of this patent is extended or adjusted under 35 U.S.C. 154(b) by 0 days.

(21) Appl. No.: 09/534,593

(22) Filed: Mar. 27, 2000

(51) Int. Cl.[7] ..... H01J 35/08
(52) U.S. Cl. ..... 378/143; 378/125; 378/144
(58) Field of Search ..... 378/119, 121, 378/125, 128, 129, 140, 143, 144

(56) References Cited

U.S. PATENT DOCUMENTS 1,714,975 A * 5/1929 Coolidge ..... 378/140
3,334,228 A 8/1967 Mattson
4,107,563 A 8/1978 Oddell
4,399,551 A 8/1983 Grady
4,413,356 A 11/1983 Hartl
4,799,249 A 1/1989 Paulikas
6,154,521 A * 11/2000 Campbell ..... 378/125
6,185,276 B1 2/2001 Eastman
6,353,658 B1 * 5/2002 Trebes et al. ..... 378/123

FOREIGN PATENT DOCUMENTS

JP 56106357 A * 8/1981 ..... 313/32

* cited by examiner

*Primary Examiner*—David P. Porta
*Assistant Examiner*—Therese Barber
(74) *Attorney, Agent, or Firm*—John H. Crozier

(57) ABSTRACT

In a preferred embodiment, an X-ray producing device, including: an X-ray tube; a cathode disposed in the X-ray tube to produce a stream of electrons; and a spherical anode disposed in the X-ray tube to have impinged on a point thereon the stream of electrons and to produce thereby a stream of X-rays.

9 Claims, 5 Drawing Sheets

X-RAY TUBE HAVING SPHERICAL ANODE

BACKGROUND OF THE INVENTION

1. Field of the Invention

The present invention relates to X-ray tubes generally and, more particularly, but not by way of limitation, to a novel X-ray tube having a spherical anode.

2. Background Art

Originally, an X-ray tube had a fixed tungsten target, or anode, that produced X-rays at an angle out of the tube the X-rays being were emitted when electrons impinged on the tungsten anode. This arrangement created a problem with heating of the fixed tungsten target. The life of an X-ray tube is generally proportional to the available surface area of the target, with small target areas resulting in lower life and concomitant higher overcall costs for an X-ray installation.

In a further development, a rotating disk is used to produce a greater target area and to reduce problems with heating and heat dissipation. In yet a further development, X-ray tubes with rotating cone-shaped targets were developed. Such X-ray tubes greatly increase surface area, but still suffer from problems with limited surface area.

The increased surface area does allow the heat and energy load to be distributed over a larger surface area (focal track), thus increasing tube capacity. Additionally, the larger mass serves as a better heat sink compared with a stationary anode. Rotor speeds are usually in the range of from about 3000 to about 10,000 rpm.

The rotating shaft of such X-ray tubes is bearing mounted and usually constructed of molybdenum, a poor conductor of heat. Nevertheless, the heat from the anode is transferred to the rotor bearings and they are often the cause of X-ray tube failure.

Another limitation with conventional X-ray tubes is that there is a pronounced "heel effect" that reduces the intensity of the X-ray beam on the anode side of the tube. Such effect causes the X-rays produced in the area of the target to be attenuated, or partially absorbed, by the target itself before being able to be used for diagnostic purposes. This makes for a variable image, darker on the cathode side of the film.

The relatively small anode surface areas of conventional X-ray tubes limits the degree of heat removal therefrom and concomitantly limits the rate of use of such X-ray tubes, in order to prevent damage to the X-ray tubes due to overheating. Radiologists and radiologic technicians must go to some effort to make sure that an X-ray tube is not damaged by overheating. For example, radiologists and radiologic technicians have to analyze X-ray tube heating and cooling charts to determine X-ray tube output limits and cooling times before it is safe to use a tube again and must adhere to the results of the analysis to avoid overheating of the X-ray tube.

In summary, some of the limitations of conventional X-ray tubes are:

Heat loading limits tube output.

Heat build-up requires cooling time before next use.

Heat loading damages targets and shortens tube life.

Heat loading is transferred to bearings, shortening tube life.

Molybdenum stem (in rotating disk tubes) may warp, causing wobbling of the anode.

There is a pronounced heel effect.

Some devices that address increasing target area and the cleaning thereof are disclosed in the following patents:

U.S. Pat. No. 3,334,228, issued Aug. 1, 1967, to Mattson, and titled X-RAY SPECTROMETER HAVING AN X-RAY SOURCE WITH A CONTINUOUSLY CLEANED X-RAY TARGET, describes an X-ray source having a rotating cylindrical target. Cleaning of the target is effected by sputtering off contaminants with ionized gas.

U.S. Pat. No. 4,107,563, issued Aug. 15, 1978, to Oddell, and titled X-RAY GENERATING TUBES, describes in one embodiment a rotating cone-shaped target that is reciprocated along its axis of rotation to vary the path of the X-rays. In another embodiment, the surface of the target is shaped so that the path varies as the target is rotated without having to reciprocate the target.

U.S. Pat. No. 4,399,551, issued Aug. 16, 1983, to Grady, and titled X-RAY TUBE HAVING ROTATABLE TRANSVERSELY OSCILLATORY ANODE, describes a rotating disk-shaped target that is movable transversely with respect to its axis of rotation to provide a spirally arranged focal track on the surface of the target to facilitate heat dissipation.

U.S. Pat. No. 4,413,356, issued Nov. 1, 1983, to Hartl, and titled FLAT ROTARY-ANODE X-RAY TUBE, describes a rotating disk that has a cone-shaped target surface on the outer periphery thereof. The patent is directed to the bearing arrangement for the disk.

U.S. Pat. No. 4,799,249, issued Jan. 17, 1989, to Paulikas, and titled SELF-CLEANING ROTATING ANODE X-RAY SOURCE, describes a rotating cylindrical target including a self-cleaning feature similar to the 1228 patent above.

None of the foregoing patents discloses an X-ray tube having a target with a greatly increased available target area and reduced heel effect.

Accordingly, it is a principal object of the present invention to provide an X-ray tube having a target with a greatly increased area.

It is a further object of the invention to provide such an X-ray tube that facilitates cooling of the target.

It is another object of the invention to provide such an X-ray tube that reduces the heel effect.

It is an additional object of the invention to provide such an X-ray tube that is economical.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an X-ray producing device, comprising: an X-ray tube; a cathode disposed in said X-ray tube to produce a stream of electrons; and a spherical anode disposed in said X-ray tube to have impinged on a point thereon said stream of electrons and to produce thereby a stream of X-rays.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
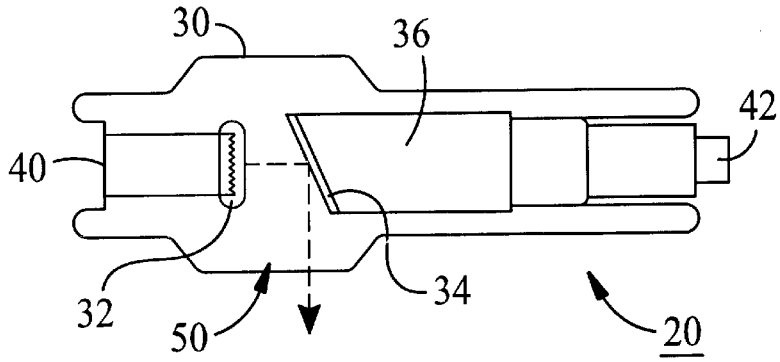
FIG. 1 (Prior Art)
FIG. 1 is a side elevational view, in cross-section, of one type of conventional X-ray tube.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

The X-ray tube was invented in 1895 by a German physicst named Wilhelm Conrad Roentgen whose invention won him the Nobel Prize for Physics in 1901.

An early X-ray tube is illustrated on FIG. 1 where the X-ray tube is generally indicated by the reference numeral 20. Tube 20 includes an evacuated glass housing 30 in which is disposed a cathode 32 and a tungsten target 34 set in a copper anode 36. Suitable connections 40 and 42 are provided at the ends of the tube for connection to a source of electrical power (not shown).

In use, a voltage imposed across tube 20 causes cathode 32 to emit electrons which accelerate across the tube towards and striking tungsten target 34 on anode 36. This produces X-rays that are then directed through a window area 50 in tube 20 and toward a patient (not shown) to produce a diagnostic image on a suitable medium (not shown). The general path of the electrons and the X-rays is indicated generally by the broken line arrow on FIG. 1.

In time, more efficient generators were produced, providing large amounts of power and making the X-ray tube itself the limiting factor in diagnostic X-ray production. About five percent of the energy transferred to the anode goes into the production of X-rays, leaving 95% of the transferred energy to produce heat. This limited the rate of X-ray production, so as not to damage the tungsten anode through cracking or pitting. In stationary tubes, the small target area limits heat dissipation and, thus, X-ray output.

Figure 2:
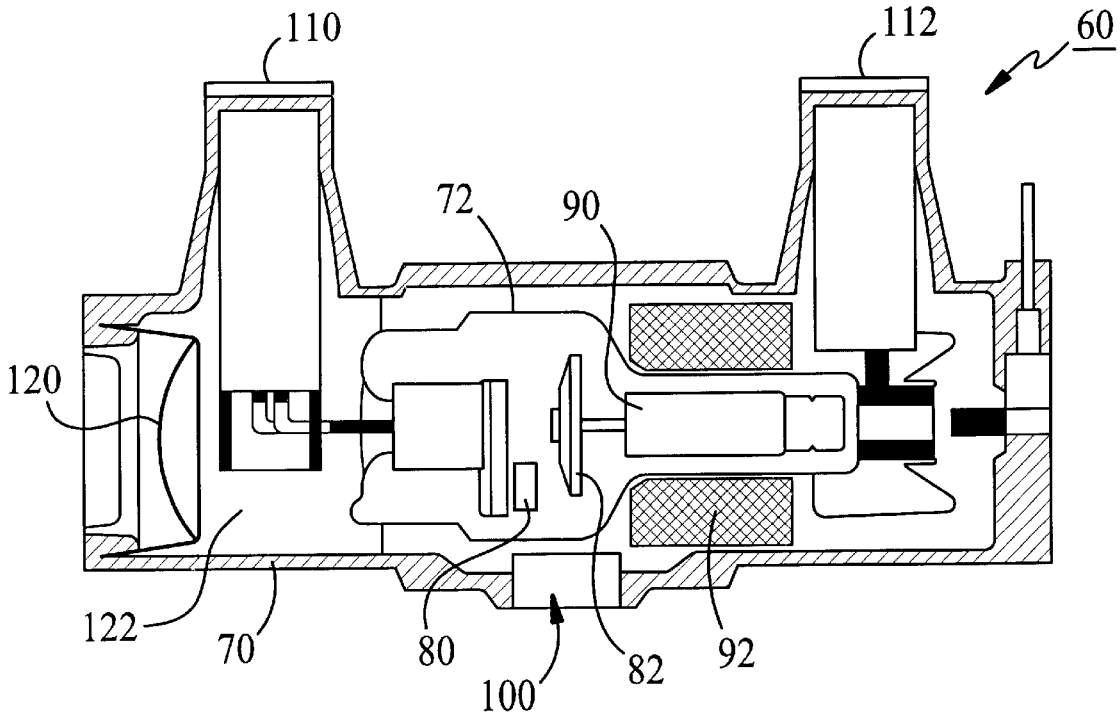
FIG. 2 (Prior Art)
FIG. 2 is side elevational view, in cross-section, of another type of conventional X-ray tube.

As noted above, a second type of X-ray tube has an anode that is rotating. Such an X-ray tube assembly is shown on FIG. 2, generally indicated by the reference numeral 60. X-ray tube assembly 60 has an outer, transformer-oil-filled, housing 70 in which is disposed an evacuated X-ray tube 72. Disposed within X-ray tube 72 is a cathode 80 and a rotating tungsten disk anode, or target, 82. Tungsten disk anode is operatively connected to, and rotated by, a rotor 90 that is in electromagnetically cooperating relationship with a stator 92. As was the case with X-ray tube 20 (FIG. 1), a stream of electrons generated by cathode 80 strikes tungsten disk anode 82 which emits X-rays, the X-rays exiting X-ray tube assembly 60 through a window area 100. Ports 110 and 112 for electrical connections (not shown) are provided at the upper end of X-ray tube assembly 60. An expansion bellows 120 is provided at one end of oil-filled housing 70 to accommodate expansion and contraction of transformer oil 122.

In the improvement of X-ray assembly 60 (FIG. 2) over X-ray tube 20 (FIG. 1), a focal spot became a focal track. Assuming a five centimeter average focal track radius, rotating anode 82 provides an annular area over 300 times that of a stationary anode with an equivalent target area. However, even that increase has the disadvantages noted above.

Figure 3:
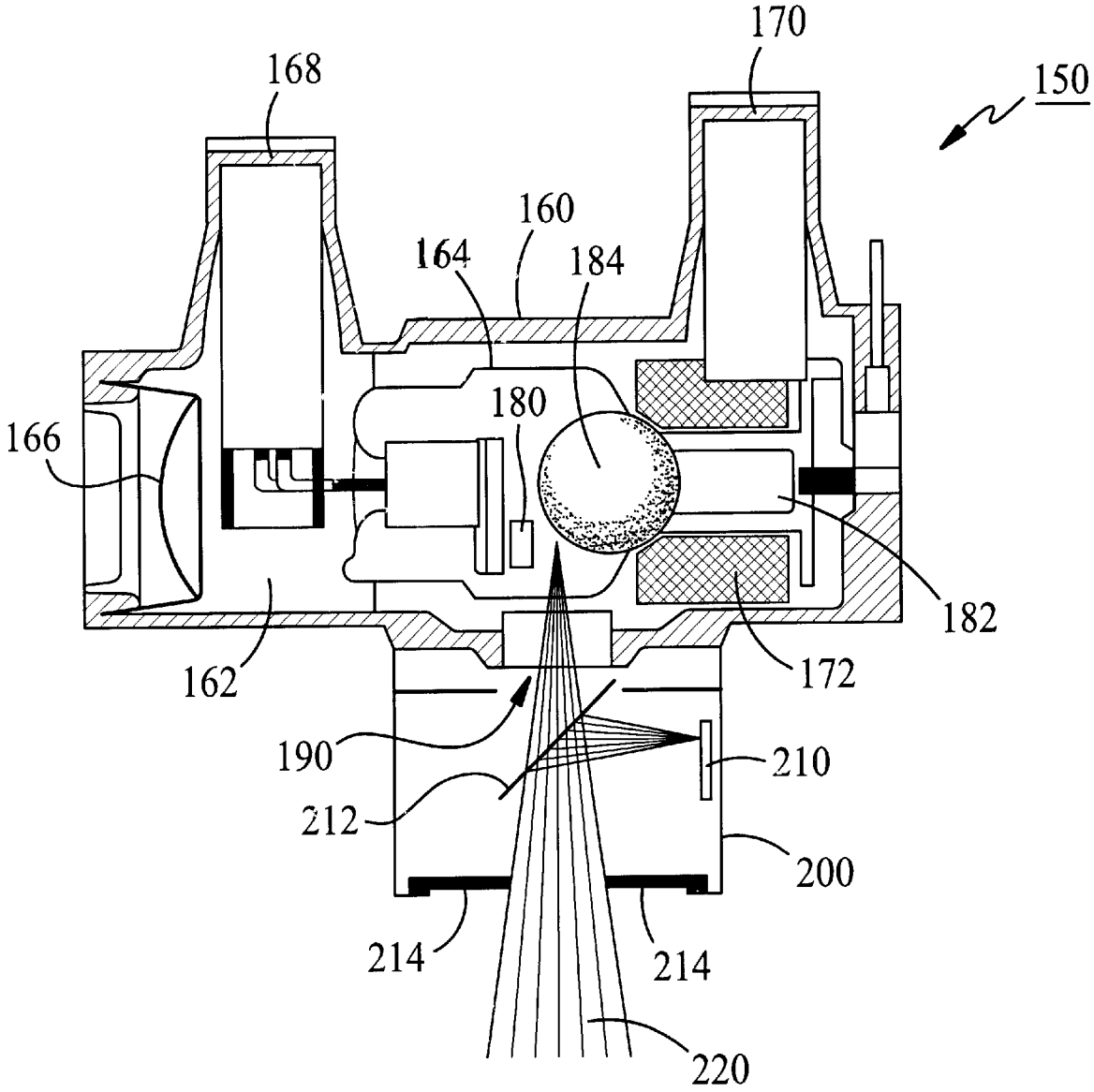
FIG. 3 is a schematic, side elevational view, in cross-section, of an X-ray tube constructed according to the present invention, employing a spherical tungsten anode.

FIG. 3 illustrates an X-ray tube assembly, constructed according to the present invention, and generally indicated by the reference numeral 150. Most of the components of X-ray tube assembly 150 are the same as similar components of X-ray tube assembly 60 (FIG. 2) and include a housing 160 filled with transformer oil 162, an evacuated X-ray tube 164, an expansion diaphragm 166, electrical connection ports 168 and 170, and a stator 172. Disposed within X-ray tube 164 are a cathode 180, a rotor 182, and, according to the present invention, a spherical tungsten anode, or target, 184. Means of support of spherical tungsten anode 184 are not indicated on FIG. 3.

As was the case with X-ray assembly 60 (FIG. 2), a stream of electrons emitted by cathode 180 strikes anode 184 and exits a stream of X-rays from assembly 150 through a window area 190. Also shown on FIG. 3, for completeness, is a collimator assembly 200. Collimator assembly 200 is conventional and includes therein a collimator light 210, a mirror 212 and collimator blades 214. Collimator assembly 200 is provided so that an operator of X-ray assembly 150 will have a visible light field 220 coextensive with the field of the stream of X-rays so that the non-visible stream of X-rays can be located on a patient or other target.

It will be understood that spherical tungsten anode 184 is rotated and turned such that substantially the entire surface of the anode is used. This provides a much larger surface area over the arrangements of conventional X-ray tubes. For example, if the radii of a rotating disk and a sphere are both 50 mm, then replacing the disk with the sphere will increase the surface area by a factor of about 100. In actuality, the increase will be something greater, since the sphere is using its outer surface as a target area, while the disk is using a smaller inner circumference.

This increased surface area will greatly improve tube life, as well as tube output. If tube life is often limited by target pitting and cracking from prolonged bombardment with electrons, more target area will spread out the damage and, therefore, lengthen tube life. Tube output, which is often a limiting factor in diagnostic imaging today, also will be improved with the increased surface area. Increase current capabilities will allow shorter exposure times, thereby decreasing artifact from patient motion. Additionally, with the electron beam exposure spread out over a larger area, tube cooling time will be shorter, as each spot on the sphere's surface is "hit" less often with electrons, therefore not accumulating as much heat. Also, the mass of the sphere is larger than that of a disk and, therefore, provides a larger heat sink to assist in cooling.

Tube life will be extended, due to reduced bearing failure. In rotating anode tubes, heat is transferred to the bearings via the molybdenum shaft, causing bearing and, therefore tube failure. Additionally, without the molybdenum shaft, there will be no warping thereof which causes "wobble".

The heel effect, as noted above, is caused by the anode itself absorbing, or attenuating, a portion of the X-ray beam. With a spherical instead of a disk target, there should be a smaller percentage of the diagnostic beam that is attenuated. This is attributable to the different shapes of the anode-spherical vs. squared off.

In summary, the advantages of the present invention include:

Greater heat loadability, resulting in:
- increased tube output, and
- improved anode cooling.

Larger heat sink.

Much larger surface area.

Reduced bearing failure.

No shaft warpage due to heating.

Less heal effect.

Figure 4:
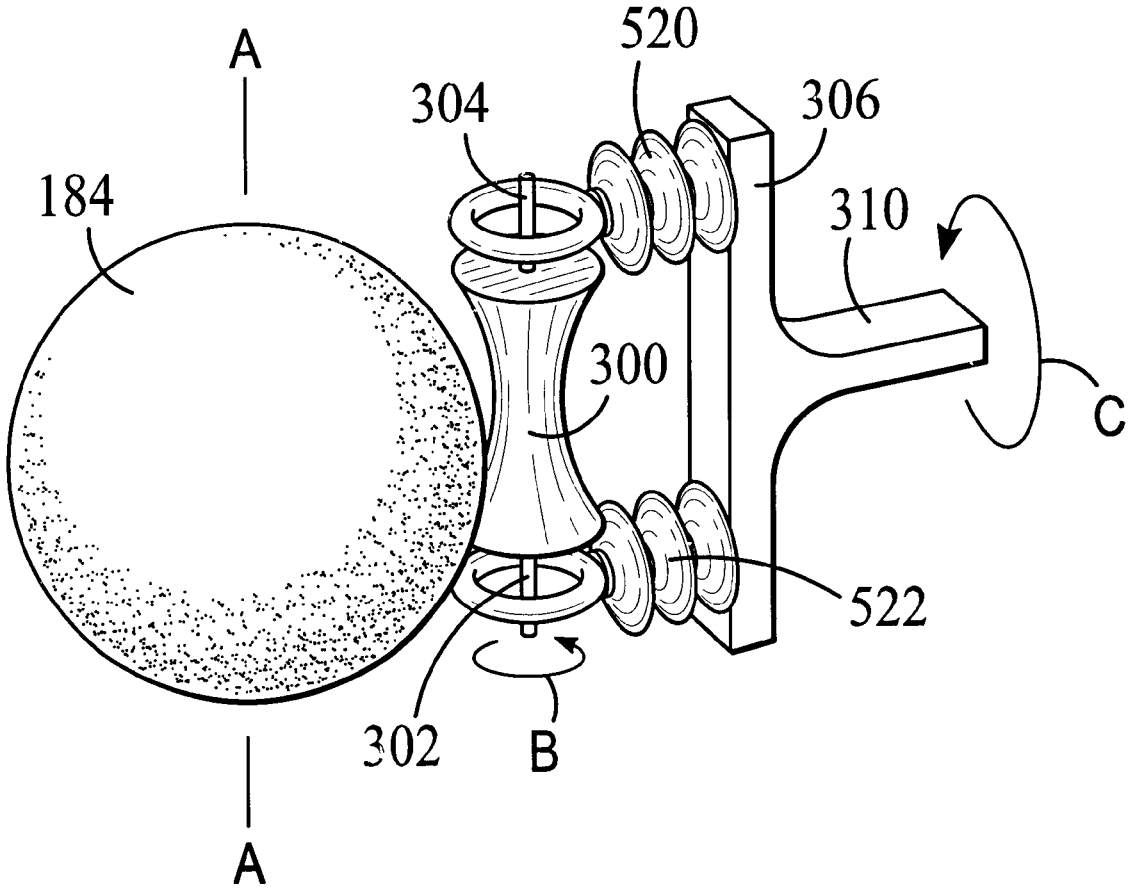
FIG. 4 is a schematic isometric view of the spherical tungsten anode of the present invention, showing a means of providing motion to the spherical anode.

FIG. 4 illustrates a method of rotating and turning spherical tungsten anode 184. Here a spindle 300 contacting spherical tungsten anode 184 has its ends 302 and 304 rotatingly journaled, respectively, in resilient mountings 520 and 522 attached to the ends of a U-shaped yoke 306. As shown on FIG. 4, rotation of spindle 300 will cause spherical tungsten anode 184 to rotate about axis "A—A". Rotation of spindle 300 is indicated by arrow "B" on FIG. 4 However, rotation of shaft 310 to which yoke 306 is fixedly attached will cause spherical tungsten anode 184 to rotate about other axes. Rotation of shaft 310 is indicated by arrow "C" on FIG. 4. It will be understood, therefore, that proper selection of the rates of the rotations of spindle 300 and yoke 306 will cause the spot (not shown) at which an electron beam (not shown) is focused on spherical tungsten anode 184 to change such that substantially the entire surface area of the spherical tungsten anode can be a target.

Figure 5A:
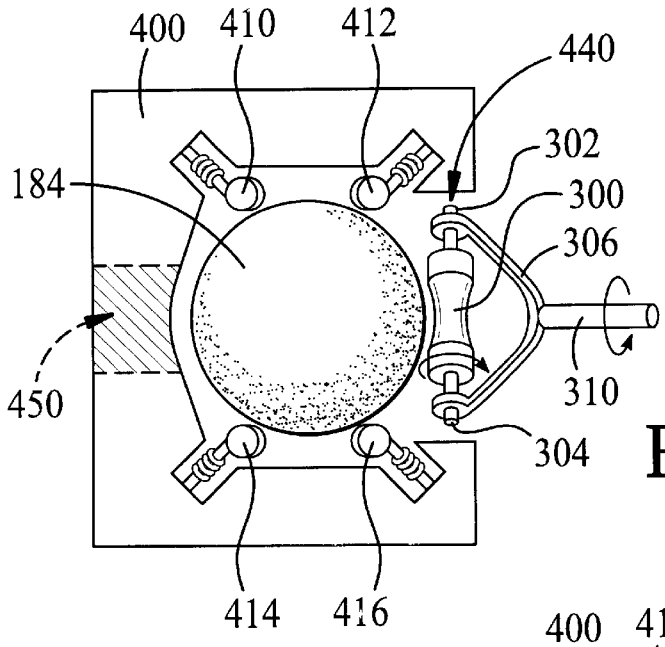
FIGS. 5(A), 5(B), and 5(C) are schematic top plan, side elevational, and front elevational views, respectively, of a mounting arrangement for the spherical tungsten anode of the present invention.
Figure 5B:
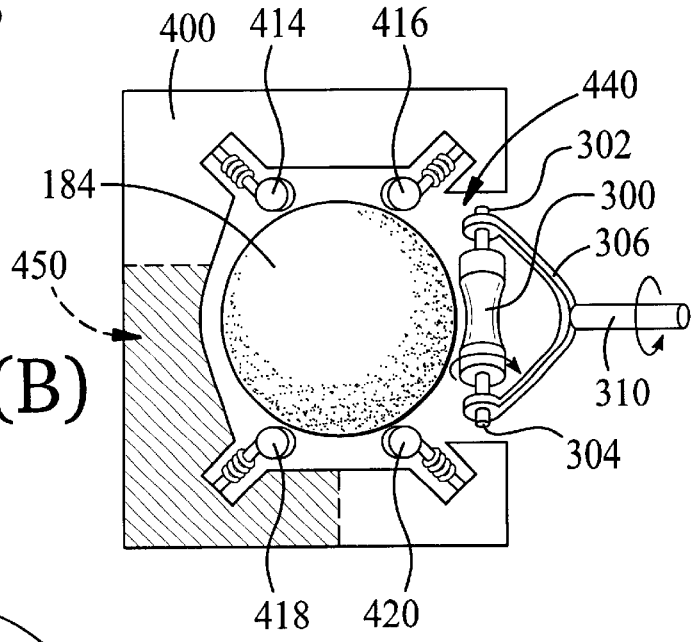
Figure 5C:
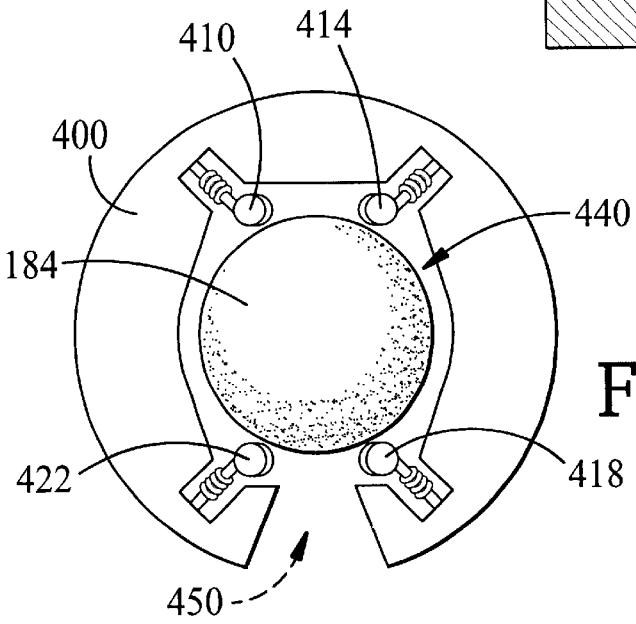

FIGS. 5(A), 5(B), and 5(C) illustrate spherical tungsten anode 184 supportingly mounted in a cylindrical support block 400. Eight casters 410, 412, 414, 416, 418, 420, and 422 (only seven shown on the present figures) support spherical tungsten anode 184 within support block 400, the casters being spring loaded and having the ability to swivel in any direction required by the spherical tungsten anode. The casters' positions should correlate to the eight corners of an equivalent cube and the angles thereof will be perpendicular to the tangent of the sphere at any point. This should allow good support while X-ray tube 182 (FIG. 3) is in any position or orientation.

Spindle 300 and yoke 306 extend into support block 400 through an opening 440 (FIGS. 5(A) and 5(B)) defined in the rear thereof. A window opening 450 defined in the front of support block 400 permits the entrance of an electron beam and the exit of an X-ray beam to and from the support block without any attenuation thereof. The casters may be able to relay heat to support block 400, making the support block something of a heat sink and the casters may also be employed to give spherical tungsten anode its charge.

Figure 6:
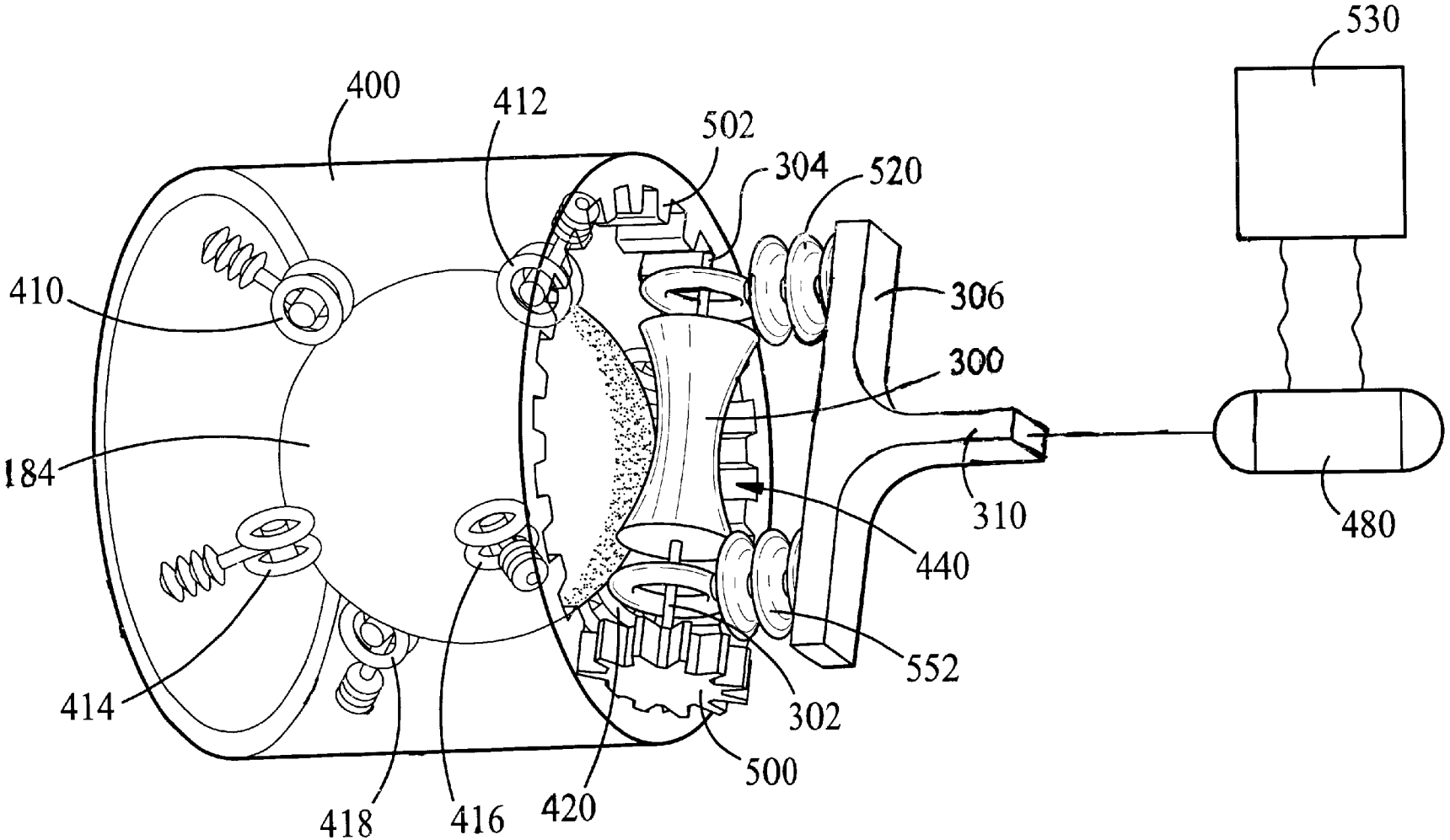
FIG. 6 is a schematic isometric view of an arrangement whereby the spherical tungsten anode of the present invention can be rotated and turned by a single motor.

FIG. 6 illustrates a method by which a single motor may be employed to rotate spindle 300 and yoke 306. Here, a motor 480, which may be assumed to be a schematical representation of stator 172 and rotor 182 (FIG. 3) is connected to rotate shaft 310. End 302 of spindle 300 has fixedly attached thereto a gear 500 that engages a complementarily shaped ring gear disposed on the inner periphery of opening 440. Thus, rotation of shaft 310 causes gear 500 to rotate spindle 300. Proper selection of gears 500 and 502 permits the entire surface of spherical tungsten anode 184 to serve as a target.

Also shown on FIG. 6 are resilient mountings 520 and 522 for ends 304 and 302, respectively, of spindle 300 and control circuitry 530 operatively connected to motor 480 to control the speed thereof.

The point on which the electron bean hits the target determines the anode angle. In conventional X-ray tubes, the cathode includes two filaments disposed in a focusing cup, a small filament to produce a small focal spot and a large filament to produce a large focal spot. Only one filament is used at a time and the electron beams produced by the filaments strike the tungsten target at the same point. This can easily be done, as well, in the X-ray tube assembly of the present invention. Additionally, the use of a spherical target permits the angle of the X-ray beam to be changed. This can be accomplished by providing two focusing cups, each with one or more filaments, directed at different points on the sphere, thus selectively producing one of two different angles of X-rays. Alternatively, a single focusing cup could be provided and the spherical target could be moved to change the anode angle.

The non-conventional elements of the present invention may be economically formed of suitable materials by conventional manufacturing means.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and/or method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An X-ray producing device, comprising:

(a) an X-ray tube;

(b) a cathode disposed in said X-ray tube to produce a stream of electrons; and (c) a fully spherical anode disposed in said X-ray tube to have impinged on any point thereon said stream of electrons and to produce thereby a stream of X-rays.

2. An X-ray producing device, as defined in claim 1, further comprising: apparatus to rotate and turn said fully spherical anode, such that said point on which said stream of electrons impinges changes.

3. An X-ray producing device, as defined in claim 2, wherein: said point successively changes such that all surface area of said fully spherical anode is used as a target.

4. A method of producing a stream of X-rays, comprising:

(a) causing a stream of electrons to be produced in an X-ray tube; and (b) striking at any point on a fully spherical anode disposed in said X-ray tube with said stream of electrons to produce thereby said stream of X-rays.

5. A method of producing a stream of X-rays, as defined in claim 4, further comprising: rotating and turning said fully spherical anode, such that said point on which said stream of electrons strikes changes.

6. A method of producing a stream of X-rays, as defined in claim 5, further comprising: successively changing said point such that all surface area of said fully spherical anode is used as a target.

7. An X-ray producing device, comprising:

(a) an X-ray tube;

(b) a cathode disposed in said X-ray tube to produce a stream of electrons; and (c) a fully spherical anode disposed in said X-ray tube to have impinged on a point on a fully spherical surface thereon said stream of electrons and to produce thereby a stream of X-rays.

8. An X-ray producing device, as defined in claim 7, further comprising: apparatus to rotate and turn said fully spherical anode, such that said point on which said stream of electrons impinges changes.

9. An X-ray producing device, as defined in claim 8, wherein: said point successively changes such that substantially all surface area of said fully spherical anode is used as a target.

* * * * *